US005220734A

United States Patent [19]

Carver

[11] Patent Number: 5,220,734

[45] Date of Patent: Jun. 22, 1993

[54] APPARATUS COMPRISING STRAPS WITH END ATTACHMENTS FOR REMOVABLY FASTENING OBJECTS TO BE DRIED WITHIN DRYER DRUM

[75] Inventor: Bettie L. Carver, Turlock, Calif.

[73] Assignee: L&W Designs, Turlock, Calif.

[21] Appl. No.: 668,188

[22] Filed: Mar. 12, 1991

[51] Int. Cl.[5] ..... D06F 58/00

[52] U.S. Cl. ..... 34/133 E; 34/239; 34/104

[58] Field of Search ..... 34/104, 106, 133, 239; 248/205.1, 205.2, 205.3, 206.2, 206.3, 206.5

[56] References Cited

U.S. PATENT DOCUMENTS

| | | | |
|---|---|---|---|
| 3,256,616 | 6/1966 | McGoldrick | 34/104 |
| 3,316,659 | 5/1967 | Lauck | 34/133 |
| 4,053,992 | 10/1977 | Furgal | 34/60 |
| 4,091,548 | 5/1978 | Daily | 34/133 |
| 4,109,397 | 8/1978 | Daily | 34/239 |
| 4,530,168 | 7/1985 | Petre | 34/106 |
| 4,677,760 | 7/1987 | St. Louis | 34/239 |
| 4,702,016 | 10/1987 | Grigsby et al. | 34/104 |
| 4,734,027 | 3/1988 | Adams | 425/556 |
| 4,813,641 | 3/1989 | Wilson | 34/104 |

*Primary Examiner*—Henry A. Bennet
*Assistant Examiner*—Denise L. F. Gromada
*Attorney, Agent, or Firm*—David Pressman

[57] ABSTRACT

An apparatus for drying shoes, soft toys, or similar objects in a commercial dryer with a rotating drum (116) comprises a pair of strong nylon straps (20) and (22) with hook-and-loop fasteners to interconnect both straps. On their respective free ends the straps have respective suction cups (32 and 34). For securing a shoe or a pair of shoes (118 and 120) directly to the surface of the drying drum (116), the suction cups are attached to this surface, and free ends of the straps are tightened over the shoes (110 and 120) and fixed to each other. In other embodiments the suction cups are replaced by adhesive pads (56 and 58), permanent magnets (86 and 88), metal hooks (102 and 104), and a pair of rings (37 and 39) attached to one suction cup (33) and a smooth strap (35) attached to the other suction cup (31). The method comprises the steps of providing flexible straps with elements for removably attaching the straps to the surface of the rotating drum, attaching the above-mentioned elements to the surface of the drum on both sides of an object to be dried, and securing the object in place by stretching the straps, guiding one of them or both around the object, and connecting the free ends of the straps to each other, while maintaining the straps under tension, and thus attaching the object directly to the inner surface of the drum.

23 Claims, 3 Drawing Sheets

APPARATUS COMPRISING STRAPS WITH END ATTACHMENTS FOR REMOVABLY FASTENING OBJECTS TO BE DRIED WITHIN DRYER DRUM

BACKGROUND

1. Field of the Invention

The present invention relates to drying, particularly to the drying of shoes, soft toys, and similar objects, in a dryer.

2. Description of Prior Art

It is not uncommon for athletic shoes or sneakers to become wet. This may occur, for example, when it rains unexpectedly and an individual must walk across wet ground and/or through wet grass to reach a desired destination. Such shoes may also become sweaty and dirty and need washing to restore their appearance and eliminate undesired odor. Since the wearing of wet shoes is neither comfortable nor healthy, it is of course desirable to dry the shoes before they are worn again.

The same relates to soft or stuffed toys which often become wet or dirty when children play on a rainy day or simply leave them on the ground or wet grass.

The drying of wet shoes, soft toys, or similar items may be accomplished in a number of different ways. They may simply be exposed to the atmosphere. Although this prevents damage due to excessive heat, it may require a long period of time, depending on humidity and temperature. Also they may become mildewed before they become dry.

To achieve more rapid drying, some individuals have resorted to placing items in an oven. However, ovens for baking food are not designed for drying items. Therefore, even on a relatively low temperature setting, the elements that heat the oven may make the items sufficiently hot to cause them to shrink or warp. If soles of shoes or parts of soft toys are made of rubber or plastic, these may be irreversibly deformed, softened, and fused to the surface of the oven rack.

Wet shoes and soft toys can also be cycled through an automatic clothes dryer so as to rapidly dry them in a relatively short time. Conventional automatic dryers include a rotating metal drum with a number of radially extending vanes on the inner surface of the drum for tumbling clothes. Tumbling exposes the greatest surface area of the clothes to the drying air currents passing through the drum so as to improve overall drying effectiveness and efficiency.

However, although the rotating and tumbling action produced by the dryer is effective for drying spreadable objects, such as clothes, it is inappropriate for drying shoes, soft toys, or similar shape-keeping unspreadable and relatively dense objects. This is because such objects will be tossed repeatedly in the drying drum, bounce against the walls of the drum, and produce annoying banging noises. The shoes, soft toys, etc., may become damaged by scuffing against each other or the vanes or walls of the drum. Heavy shoes may even damage the vanes, or the surface of the drum itself.

In order to solve the problems associated with tumbling of shoes in an automatic dryer, it has been proposed to use a special apparatus for drying shoes in a dryer. This apparatus, described in U.S. Pat. No. 4,702,016 to S. Grisby et al., October 1987, comprises a special platform for mounting and securing shoes to be dried. The platform itself is attached to metal walls of the drying drum by powerful magnets.

Although the Grisby device solves the problems associated with tumbling of shoes being dried in an automatic dryer, it has a number of disadvantages.

First, the Grisby device does not attach shoes or similar objects to be dried directly to the surface of the drum, but involves the use of an intermediate member. i.e. it uses a mounting platform which has means for securing the shoes and means, such as magnets, for attaching the platform to the inner surface of the drying drum. This platform (several such platforms are used for drying several pairs of shoes) increases the weight of the items in the drum, and occupies useful space inside the drum. Also, the magnets which are used for attaching the platform to the drum's surface have to be strong enough to hold in place the object being dried, and also the platform itself. Therefore, they are heavy and expensive. The shoe-holding platform itself is a rather complicated device of complex configuration with special lips for preventing the shoes from slipping. Therefore, it is expensive and difficult to make. Because it employs magnets, the Grisby device is limited to use in dryers with ferrous metal drums. At the present time many heat-resistant and shockproof plastics are available on the market, and it is quite possible that replaceable drums molded from such plastics or nonferrous metals, such as aluminum, may appear. In this case, the Grisby device, will be unusable.

In case, for any unexpected reason, Grisby's platform becomes separated from the surface (there is a great chance that this may happen when an inexperienced user attaches very heavy item to the platform), the drying drum may be damaged. This is because the metal platform and the heavy magnets will impart strong blows upon the surfaces of the thin-walled drying drum. These blows will be damaging, even when the platform is made of plastic.

A further disadvantage of the Grisby device is that it is rigid and not flexible, not universal in use, and therefore cannot use the radial paddles or vanes of the drum to support shoes or other objects inside the drum. In other words, although the Grisby device can be moved closer to the vane and even rest on it, the vane itself cannot be efficiently used as an additional support means for the items to be dried.

OBJECTS AND ADVANTAGES OF THE INVENTION

It is therefore an object of the invention to eliminate the above disadvantages and to provide such a method and apparatus for drying shoes, soft toys, or similar objects in a dryer with a rotating drying drum which ensures simple and reliable attachment of an object to be dried directly to the inner surface of the drum. Other objects are to provide the apparatus of the above-mentioned type which is simple in construction, light in weight, occupies minimum of the useful space of the dryer, is easy to use, simple to manufacture, reliable in operation, does not damage the drum, allows attachment of objects to both metal and nonmetal surfaces, and allows efficient utilization of the drying drum's vanes as additional supports for objects being dried. These and further objects and advantages of the invention will become apparent after consideration of the ensuing description with the attached drawings.

REFERENCE NUMERALS USED IN THE DRAWINGS AND DESCRIPTION

Figure 1:
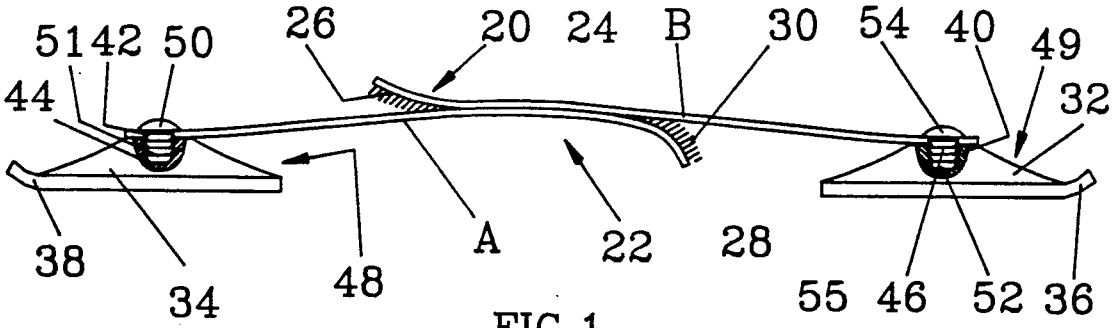
FIG. 1 is a perspective view of an apparatus of the invention with suction cups.

20, 22—straps
24, 28—smooth sides of straps
26—hook sides of strap 20
30—loop side of strap 22
31, 33—suction cups
32, 34—suction cups
55—smooth strap
37, 39—rings
36, 38—pulling tabs
40, 42—cylindrical portions
44, 46—blind holes
48, 52—rivets
50, 54—heads
51, 55—rods
56, 58—adhesive pads
60, 76—strap
62—loops
64—adhesive
66—piece of peelable paper
68, 74, 78—hooks
70—adhesive
72—piece of peelable paper
80—intermediate piece
82—adhesive
84—loops
86, 88—permanent magnets
90, 96—straps
92—hooks
94—adhesive
98—loops
100—adhesive
102, 104—metal hooks
106—strap
108—hooks
110—strap
114—smooth surface of the drum
116—drying drum
118, 120—shoes
122, 124—vanes
126, 128—shoes
127, 129—straps
130, 132—drying drums
134, 136—pairs of shoes
138—left shoe
140—right shoe
144, 146—large shoes
148, 150. 152, 154—straps
156, 158—vanes
160, 162—boots

DESCRIPTION—FIG. 1—HOLDER WITH SUCTION CUPS

FIG. 1 is a perspective view of one holding apparatus of the invention for drying shoes, soft toys, etc., in a dryer with a rotating drying drum. Hereafter reference will be made only to shoes, although other similar objects can be fixed by the holder of the invention. In this embodiment, the apparatus is fixed to the inner surface of a drying drum by suction cups.

The apparatus of FIG. 1 is composed of a pair of straps 20 and 22. Strap 20 has one smooth side 24 and another side 26 made with a dense arrangement of tiny hooks 26. Strap 22 has one smooth side 28 and another side 30 covered with a dense arrangement of loops 30. When hooks 26 are pressed to loops 30, they removably but firmly interlock with each other. Such an arrangement of hooks and loops on opposite pieces of fabric are known under trademarks "Velcro" and "Latchlock" and, at the present time, finds wide application as a closure on garments, shoes, etc. Hereinafter this connection will be referred to as a "hook-and-loop" connection.

Connected to one end of each of straps 20 and 22 are suction cups 32 and 34, respectively. Both suction cups are identical in design and may comprise cups as described in U.S. Pat. No. D302,107 issued Jul. 11, 1989 to E. Adams and in U.S. Pat. No. 4,734,027 issued Mar. 29, 1988 to the same inventor.

Such suction cups are used for attaching various objects, e.g., soap holders, to smooth surfaces, such as enamel tiles. For ease of removal of cups 32 and 34, they are provided with pulling tabs 36 and 38, respectively.

Cups of the type described in the above-mentioned patents may have diameters of 44.5 mm, 50.8 mm, and 63.5 mm and may each provide a holding force of up to 1.5 to 5 kg. The cups can be made from a heat-resistant and resilient plastic, so that they can easily withstand a temperature within the dryer which may vary within the range of 50° C. to 85° C.

On their upper ends, cups 32 and 34 have cylindrical holding portions 40 and 42, respectively. The holding portions are blind holes 44 and 46, respectively. Hole 44 is used for securing the end of strap 20 to socket cup 34 by inserting into hole 44 a rivet 48 having a head 50 and a rod 51. Rod 51 of rivet 48 is inserted into hole 44 through a hole (not shown) in strap 22 which has a diameter smaller than the diameter of head 50. Rivet is pressed into the hole of the holding portion until head 50 is firmly pressed to the end face of holding portion 40. Rivet 48 can be made of strong plastic, light metal, etc., and can be fixed in the hole by force fit or by an adhesive (not shown). In a similar manner, strap 22 is attached to socket cup 32 by a rivet 52 fixed in hole 46. Rivet 52 has a head 54 and a shaft 55.

The length of the apparatus formed by straps 20 and 22 can be adjusted by changing the length of the overlapped portion of the straps. (In FIG. 1 this is the length from point A to point B.) This length is chosen in accordance with dimensions of an object which must be attached to the inner wall of the drying drum (not shown in FIG. 1).

Straps 20 and 22 can be made from a strong synthetic fabric, such as nylon. Either or both of the straps can be made stretchable.

In one practical embodiment each strap has a length of 25 cm and a width of 25 mm.

FIG. 1A—HOLDER WITH A SINGLE STRAP

Figure 1A:
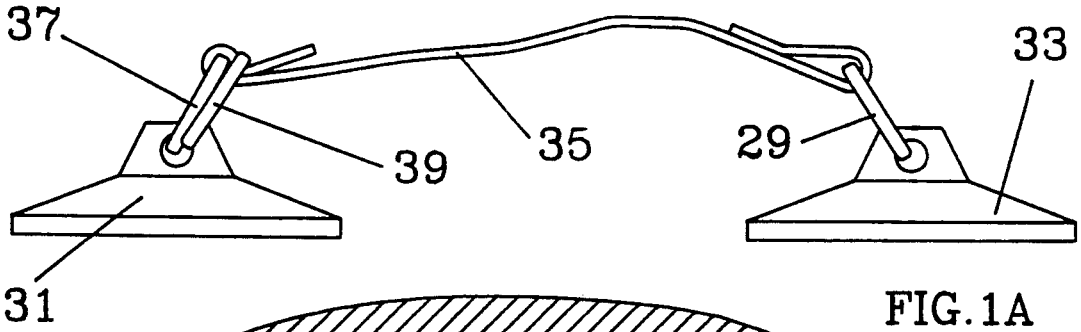
FIG. 1A is a perspective view of an apparatus utilizing a single strap and connection elements on one of elements for attachment to a drying drum's surface.

FIG. 1A is a perspective view of a similar holding apparatus according to another embodiment utilizing a single strap on one attachment element and a locking device on the other suction cup.

The attachment elements are shown in the form of suction cups 31 and 33, which are similar to cups 32 and 34 of FIG. 1. A smooth flexible strap 35 is attached to suction cup 33 through a metal ring 29 pivotally connected to cup 33. The strap is attached by passing its end through ring 29 in the form of a loop fixed, e.g., by a few stitches (not shown) of thread. As shown in FIG. 1A, the opposite end of strap 35 is free.

However, instead of connection to a second flexible strap, suction cup 33 carries two rings 37 and 39 which can be pivotally connected to the upper end of this cup.

FIG. 2—EMBODIMENT WITH ADHESIVE PADS

Figure 2:
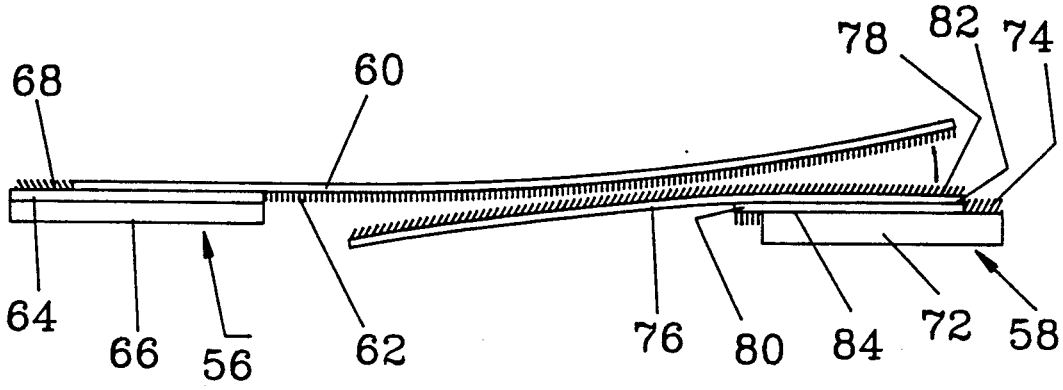
FIG. 2 is an embodiment of the apparatus with adhesive pads.

FIG. 2 is an embodiment similar to FIG. 1 but with suction cups replaced by adhesive pads 56 and 58. This embodiment may find application for dryers where drying drums are made from a nonmagnetic material or have a rather rough or perforated surface unsuitable for suction cups.

A strap 60 has one side smooth and another coated with a dense arrangement of loops 62. Attached to the end of strap 60 is an adhesive pad 56 which is made of a piece of fabric coated on one side with a layer of a strong adhesive 64. Normally, for storage, i.e., prior to use, adhesive 64 is protected with a layer of peelable paper 66. Adhesive 64 is intended for firmly attaching pad 56, and hence strap 60, to the inner surface of the drying drum (not shown in FIG. 2). The side of pad 56 opposite to adhesive 64 has dense arrangement of hooks 68 for removable attachment to loops 62 of strap 60.

Pad 58 is identical to pad 56, i.e., it consists of a piece of fabric coated with a layer of an adhesive 70 protected by a piece 72 of peelable paper. Another side of pad 58 has densely arranged hooks 74.

Similar to the embodiment of FIG. 1, the apparatus of FIG. 2 has a second strap 76. One side of strap 76 is smooth while the other side has densely arranged hooks 78 of the same type as hooks 68 and 74. Hooks 78 are intended for engagement with loops 62 of strap 60. For attaching adhesive pad 58 to the end of strap 76, this end has on its side opposite to hooks 78 an intermediate piece of fabric 80. One side of intermediate piece 80 is smooth and is permanently attached to the smooth side of strap 76, e.g., by means of an adhesive 82. If necessary, intermediate piece 80 can be sewn to strap 76. The opposite side of piece 80 has loops 84 for engagement with hooks 74 of adhesive pad 58.

Both adhesive pads 56 and 58 are disposable and can be cut from the same roll (not shown) of a continuous strap-like laminated material which has the same structure as pads 56 and 58.

Straps 76 and 60, intermediate piece 80, and pads 56 and 58 are preferably of the same width. Straps 76 and 60 may have the same length and can be made from the same material as straps 20 and 22 of the embodiment of FIG. 1.

FIG. 3—EMBODIMENT WITH MAGNETIC HOLDERS

Figure 3:
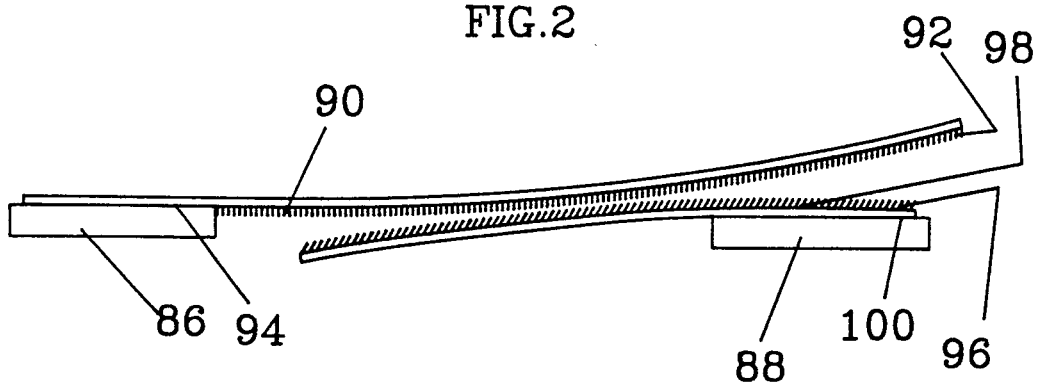
FIG. 3 is an embodiment of the apparatus with magnetic holders.

FIG. 3 is an embodiment of the apparatus with magnetic holders. In fact, this apparatus is identical to the one of FIG. 1 with the only difference that suction cups 32 and 34 are replaced by permanent magnets 86 and 88.

More specifically, a strap 90 has one side smooth and another coated with dense arrangement of hooks 92. One end of strap 90 is attached at its hooked side to permanent magnet 86, e.g., by a strong adhesive 94. A second strap, i.e., strap 96, has one side smooth and another side covered with densely arranged loops 98. One end of strap 96 is attached at its smooth side to permanent magnet 88, e.g., by an adhesive 100.

The materials, widths, and methods of interconnection of straps 90 and 96 are the same as those described with reference to FIG. 1.

In one specific embodiment, permanent magnets 86 and 88 each had dimensions of 25×50×12 mm and developed a magnetic attraction force of about 3.5 kg.

The embodiment of FIG. 3 is usable only in drums made from a ferrous metal.

FIG. 4—EMBODIMENT WITH HOOKS

Figure 4:
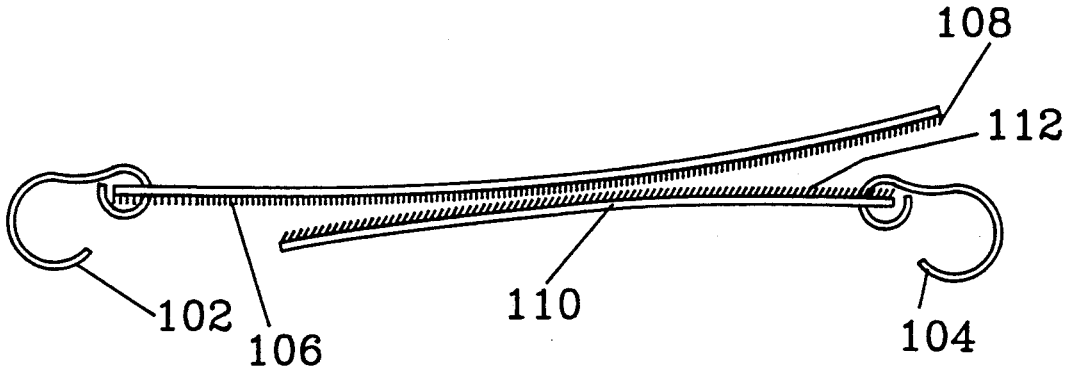
FIG. 4 is an embodiment of the apparatus with attachment hooks.

In some cases, drying drums of commercial dryers have holes or openings in the drum surface (not shown). These holes can be used as means for firmly securing in place attachment members of the apparatus of invention. An embodiment utilizing such members is shown in FIG. 4.

This apparatus is similar to one shown in FIG. 1, with the exception that suction cups 32 and 34 are replaced by metal hooks 102 and 104. Each metal hook has a roughly S-shaped configuration, with one part of S being deformed into a closed loop for securing to the end of a respective strap. Metal hook 102 is attached to a strap 106 which has one smooth side and another with densely-arranged tiny hooks 108. Metal hook 104 is attached to an end of strap 110 having one smooth side and another coated with densely arranged tiny loops which are designed for engagement with hooks 108. The straps may have the same structure and dimensions as those described in the previous embodiments.

FIGS. 5 THROUGH 10—OPERATION

The operation and method of drying with the use of the holder of the invention will be described in general for the embodiments with suction cups, keeping in mind that suction cups are attached to the smooth surface of the drum. It is understood, however, that suction cups are shown in all the drawings only as an example and that all other attachment elements, such as adhesive pads, hooks, and magnets, can be used in each illustrated embodiment instead of the cups.

In the case of embodiment of FIG. 1, suction cups 32 and 34 are attached to the smooth surface 114 of a rotating cylindrical drying drum 116 (FIG. 5) by wetting them and pressing them against the inside of the drum. Straps 20 and 22 are stretched over an object to be dried, e.g., shoes 118 and 120 of the type shown in FIG. 5, and the ends of the straps are then connected to each other by a hook-and-loop connection or by other suitable means.

In the embodiment of FIG. 1A, the suction cups and the strap are used in the same manner as in case of FIG.

1. However for securing the object in place, the free end of strap 35 is guided through both rings 37 and 39, and then pulled back through ring 37, thus tightening the connection.

For attaching apparatus of FIG. 2, the user must peel off layers 66 and 72 of protective paper to expose adhesive layers 64 and 80 and to secure respective pads 56 and 58 to surface 114 of rotating drum 116 by pressing the pads to the drum surface in locations on opposite sides of an object to be dried, e.g., an athletic shoe. Strap 60 is then attached to pad 66 through their hook-and-loop connection. Strap 76 is attached to pad 58 also through their respective hook-and-loop connection. Strap 60 is stretched, guided in a stretched state over the shoe, and is attached by means of its loops 62 to hooks 78 of strap 76, which also is stretched in the direction toward pad 56. Thus the object is fixed between interconnected straps 60 and 76 which are both maintained under tension.

The apparatus of FIG. 3 is used in the same manner as the one shown in FIG. 1 by attaching straps 90 and 96 to the surface of the metal drum with the use of permanent magnets 86 and 88. An object to be dried is fixed in the same manner as has been described with reference to FIG. 2.

The apparatus of FIG. 4 is suitable for use with drying drums having holes in their surfaces and operates in the same manner as those described above, with the exception that hooks 102 and 104 are inserted into appropriated holes (not shown). In order to reliably hold hooks 102 and 104 in their respective holes, it is important that both straps 106 and 110 be stretched with a sufficient tension so that the hooks do not get loose during drying.

Thus, the method of drying shoes, soft toys, or similar objects consists of the following steps:

A flexible, removable, fixing means is provided for removably attaching at least one object to be dried to the inner surface of a drying drum. The above-mentioned means is adjustable in length and comprises at least one pair of straps. A first end of each strap is removably interconnected to the other, and a second end of each strap has means for removably fixing it to the inner surface of the drum.

Then fixing means is attached to the surface of the drum on both sides of the object. Then the object is secured in place by stretching both straps, guiding one of them around the object and connecting first ends of the straps to each other, while maintaining them under tension.

It is recommended that shoelaces be tied or tucked inside the shoes during drying.

The objects can be fixed in dryers with various combinations and arrangements of straps and objects, as well as with various arrangements of the object with respect to radial vanes or paddles which may be present in the drying drums and used as additional supports for the objects.

Although in all subsequent drawings only suction cups are shown, it is understood that, without deviation from the main principle of the invention, the cups can be replaced by magnets, hooks, or adhesive pads.

VARIOUS ARRANGEMENTS OF OBJECTS IN THE DRUM

Figure 5:
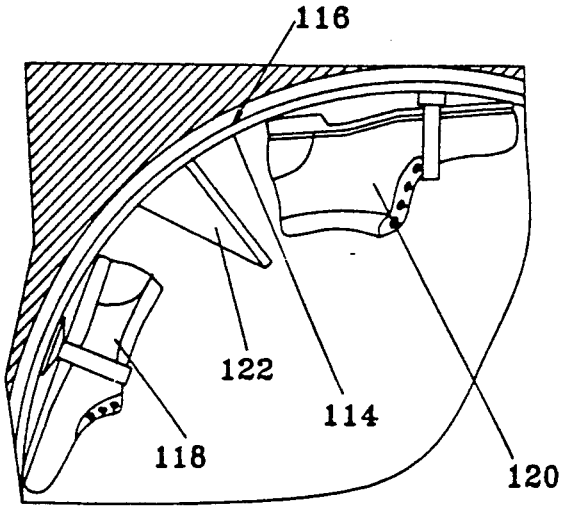
FIG. 5 is a fragmental transverse sectional view of a dryer with shoes attached to the drum by means of apparatus of the invention, the shoes being spaced from the radial vanes of the drum.

FIG. 5 is a fragmental transverse sectional view of a dryer with shoes 118 and 120 attached to the drum by means of the holder of the invention, with the shoes being spaced from a drum vane 122.

Such an arrangement may be used when shoes are dried simultaneously with other objects and when it is important that the shoes do not impair the tumbling effect of vane 122.

Figure 6:
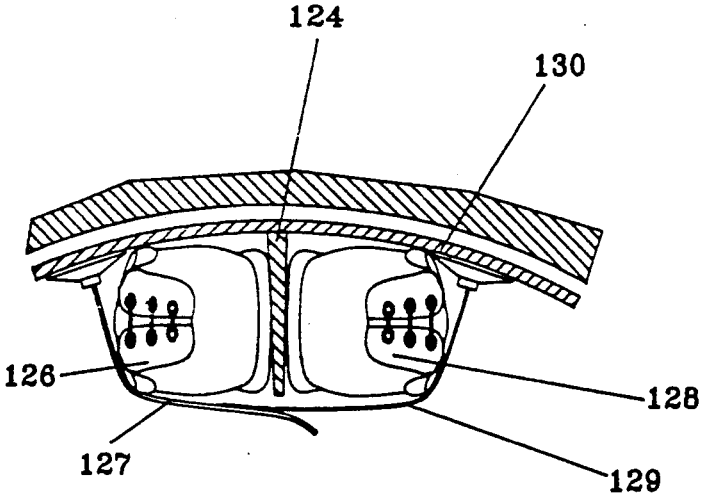
FIG. 6 is a view similar to FIG. 5 illustrating the use of a vane as an additional support for shoes arranged parallel to the drum generatrix.

FIG. 6 is a view similar to FIG. 5 illustrating the use of a vane 124 as an additional support for shoes 126 and 128 which are arranged parallel to the generatrix of cylindrical drum 130. Both shoes 126 and 128 are arranged in a sole-to-sole position to each other, resting with their soles on the opposite sides of vane 124. For such an arrangement, either shoes 126 and 128 should be of a relatively large size or vane 124 should have a relatively low height, in order to guarantee contact between tensioned straps 127 and 129 and respective shoes 126 and 128.

Figure 7:
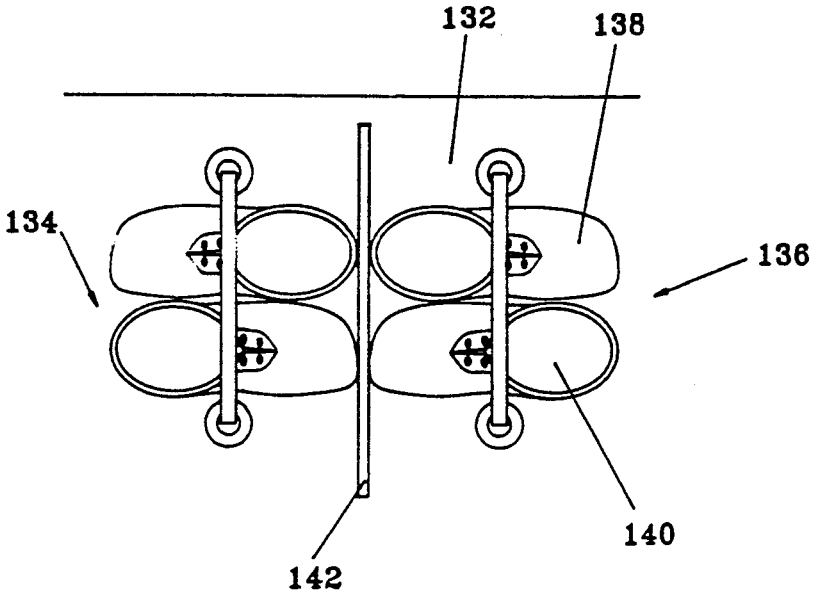
FIG. 7 is a top view on the surface of the drum illustrating arrangement of shoes in the circumferential direction of the drum.

FIG. 7 is a top view of the surface of a drying drum 132 illustrating arrangement of two pairs 134 and 136 of shoes in the circumferential direction of the drum. For a more compact and firm arrangement, left shoe 138 and right shoe 140 of pair 134 are oriented in opposite directions so that a recess on the profile of one shoe can be complimentarily filled with a projecting portion on the profile of another shoe.

In this case, both pairs 134 and 136 rest on a vane by respective sole and heel portions arranged in an alternating pattern.

Figure 8:
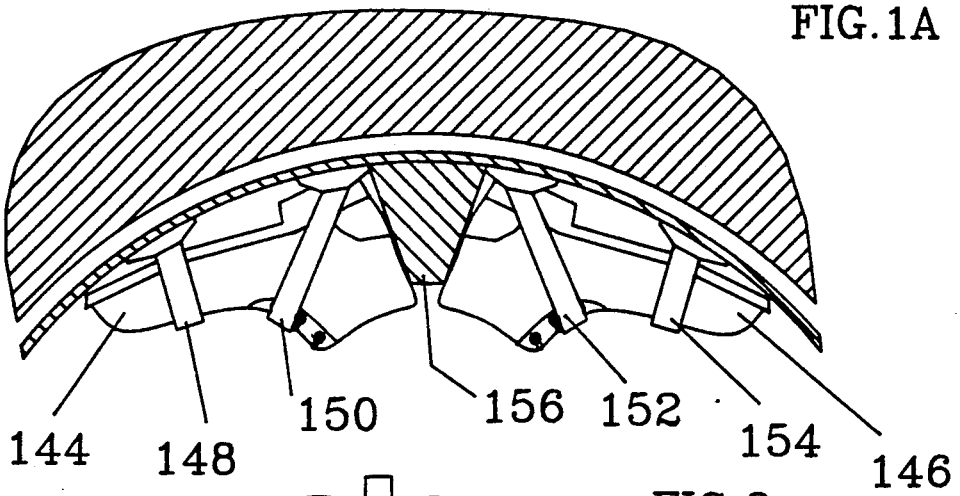
FIG. 8 is a view similar to FIG. 5 illustrating fixation of large shoes by means of two pairs of straps.

FIG. 8 is a view similar to FIG. 5 illustrating fixation of large shoes 144 and 146, e.g., heavy duty boots, by means of two pairs of straps 148 and 150 (for shoe 144) and 152 and 154 (for shoe 146). Straps 150 and 152 can be guided through respective shanks formed between the heels and soles and attached to each other above the upper sides of the shoes. The backs of the heel portions of the shoes rest on opposite sides of vane 156.

Figure 10:
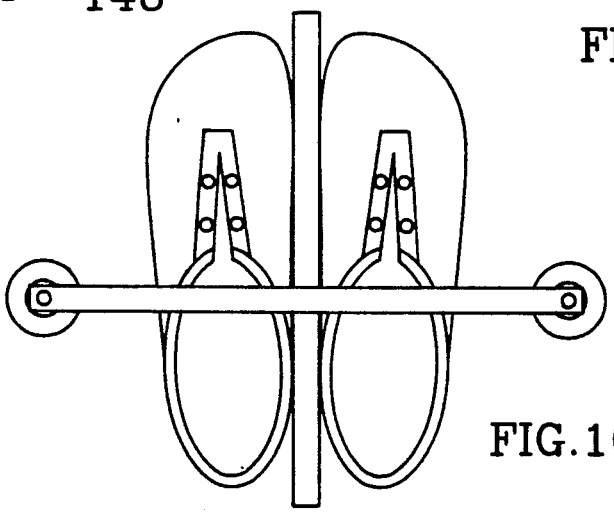
FIG. 10 is a top view of the arrangement of FIG. 9.
Figure 9:
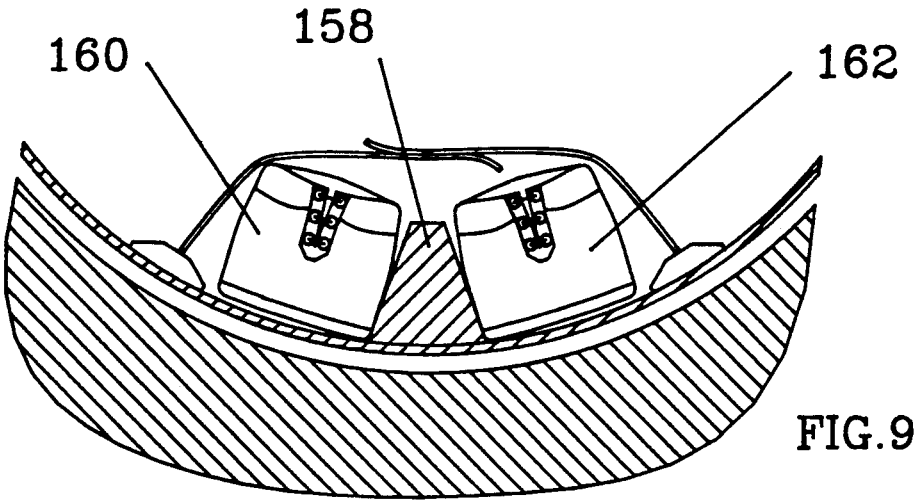
FIG. 9 is a view similar to FIG. 5 illustrating the use of a vane as a support for fixing boots or similar items of footwear of large height.

FIG. 9 is a view similar to FIG. 5 illustrating the use of a vane 158 as a support for lateral surfaces of boots 160 and 162 which are shown in a plan view in FIG. 10.

The following are examples of shoes suitable for securing and drying by the method and apparatus of the invention: training shoes, moccasins, clogs, sandals, sneakers, thongs, tennis shoes, ballerina-type shoes, loafers, chukkas, rubber shoes, overshoes, felt shoes for snow, deck shoes, heavy-duty boots, etc.

SUMMARY, RAMIFICATIONS, SCOPE

Thus, it has been shown that the invention provides a method and apparatus for drying shoes, soft toys, stuffed animals, or similar object (tumbling of which is undesirable) in a drying drum of a commercial dryer.

The method and apparatus for drying shoes described above are suitable for efficient drying shoes, soft toys, or similar objects in a dryer with a rotating drying drum and ensure simple and reliable attachment of an object to be dried directly to the inner surface of the drum. The apparatus is simple in construction, light in weight, occupies minimum of the useful space of the dryer, is easy to use, simple to manufacture, reliable in operation, does not damage the drum, allows attachment of objects to both metal and nonmetal surfaces, and allows efficient utilization of the drying drum's vanes as additional supports for objects being dried.

Although the invention has been shown and described in the form of several specific embodiments, these embodiments, their parts, materials, and configurations have been given only as examples, and many other modifications of similar apparatus are possible.

For example, the suction cup on one strap can be combined with a hook on the other strap, etc. All arrangements shown with vanes as additional support elements can be realized in the same manner without the use of vanes by securing the shoes directly to the smooth surface of the drum.

In all embodiments the straps can be connected to an appropriate attachment element through a ring and a hole of the same type shown in FIG. 1. All hook-and-loop connections between the straps can be replaced by a buckle on one strap and punched holes on the other strap. One strap may have two rings on its one end while the end of the other strap can be free of any fastening elements. In that case the ends of two straps can be connected in a known manner by guiding the free end through both rings and then pulling it backward through one of the rings to tighten the connection.

The embodiment with adhesive pads was shown and described with one of the straps having an intermediate member 80. However, this strap can be made with hooks on one side and loops on the other side, so that the strap can be formed as a single piece without the intermediate member.

The invention is not limited only to shoes, soft toys, and stuffed animals, but is applicable to any objects, the tumbling of which in a drying drum is undesirable. e.g., such objects may comprise mittens, gloves, winter caps, etc.

All arrangements shown in FIGS. 5 through 10 are possible, not only for suction cups, but for attachment devices of other types, such as adhesive pads, hooks, magnets, or their combinations. Several straps can be used simultaneously on each object.

The apparatus of the invention may find extremely useful additional applications, e.g., as means for locking refrigerator doors to prevent children from access to the refrigerator. For this purpose one suction cup can be attached to the refrigerator side or top surface, and another to the surface of the door. As babies have the center of gravity of their bodies in a position higher than that in adults or older children, cases are known when babies overturned and fell in a toilet. Therefore the straps with suction cups of the type described above can be efficiently used for locking the toilet seat cover. Such locking may also be required for preventing babies and pets from drinking water from toilet bowls, especially when this water is mixed with a disinfectant normally contained in the toilet tank.

Therefore the scope of the invention should be determined, not by the examples given, but by the appended claims an their legal equivalents.

What I claim is:

1. An apparatus for facilitating the drying of a solid object, within a dryer of the type having a rotating drum which has an inside surface defining a working chamber within said drum, said apparatus comprising:

an elongated, flexible holding member having a pair of opposite ends, said holding member containing adjustment means for enabling its length between said opposite ends to be adjusted so that said member can extend across any object within a predetermined size range, and a pair of attachment means affixed to said opposite ends of said holding member, respectively, each of said attachment means being arranged to attach its respective end of said holding member to a location on said inside surface of said drum in a manner such that said respective end of said holding member can be repeatedly attached and removed form said location on said inside surface of said drum, whereby said holding member and said attachment means can be used to attach said object easily, securely, and removably to said inside surface of said drums so as to enable said object to be dried within said drum, without tumbling said object within said drum, by extending said holding member over said object and using said attachment means to attach said opposite ends of said holding member to a pair of spaced-apart locations on said inside surface of said-drum and on opposite sides of said object.

2. The apparatus of claim 1 wherein said holding member comprises at least one pair of straps, each of which has inner and outer ends, said inner ends of said straps having connecting means for removably connecting said inner ends together, said outer ends of said straps constituting said opposite ends of said flexible holding member.

3. The apparatus of claim 2 wherein said connecting means for removably connecting said inner ends together comprises one part of a hook-and-loop fastener on at least one side of one of said straps and other part of said hook-and-loop fastener on the other of said straps, said straps being made of a heat-resistant fabric.

4. The apparatus of claim 3 wherein each of said attachment means comprises a suction cup having a vacuum suction portion and a cylindrical holding portion.

5. The apparatus of claim 4 wherein each of said suction cups is made of a thermally resistant plastic and said cylindrical portion of each contains means for attaching said suction cup to said outer end of a respective one of said straps.

6. The apparatus of claim 5 wherein each of said suction cups has at least one pulling tab for facilitating disconnection of said suction cup from said surface of said drum, said means for attaching said suction cup to said strap comprises a blind hole in said holding portion of said cup, a rivet with a cap and a rod portion, and a hole in said strap of a diameter smaller than the diameter of said cap, said rod being pressed into said blind hole to the extent that said cap is pressed to said holding portion and locks said strap, said rod portion being locked into said blind hole.

7. The apparatus of claim 6 wherein said rod portion is fixed into said blind hole by an adhesive.

8. The apparatus of claim 3 wherein said attachment means comprises first and second removable adhesive pads, each of said pads having on one side a layer of an adhesive coated with a layer of a peelable protective release paper and on its other side with one art of a hook-and-loop fastener, and wherein one of said straps has on at least one side thereof the other part of said hook-and-loop fastener for connection to said one part of said hook-and-loop fastener of said first adhesive pad, the other of said straps having means for connection to said second adhesive pad.

9. The apparatus of claim 8 wherein said connecting means comprises an intermediate member permanently attached to the side of said other strap opposite to said hook-and-loop fastener of said other strap, the opposite said of said intermediate member having one part of a hook-and-loop fastener for engagement with said one part of said hook-and-loop fastener of said second pad.

10. The apparatus of claim 3 wherein said attachment means comprises a pair of permanent magnets permanently attache dot said respective opposite ends of said holding member.

11. The apparatus of claim 3 wherein said attachment means comprises a pair of metal hooks permanently attached to said respective opposite ends of said holding member.

12. The apparatus of claim 2 wherein said straps are made of a synthetic fabric.

13. The apparatus of claim 2 wherein at least one of said straps is stretchable.

14. A method for facilitating the drying of a solid object, within a dryer of the type having a rotating drum which has an inside surface defining a working chamber within said drum, said method comprising:

providing an elongated, flexible holding member having a pair of opposite ends, said holding member containing adjustment means for enabling its length between said opposite ends to be adjusted so as to be able to extend over any object within a range of sizes, providing a pair of attachment means affixed to said opposite ends of said holding members, respectively, each of said attachment means being arranged to attach its respective end of said holding member to a location on said inside surface of said drum in a manner such that each of said respective ends of said holding member can be repeatedly attached and removed from said location on said inside surface of said drum, securing said object directly against said inside surface of said drum by extending said holding member over said object so that said pair of attachment means are positioned on opposite sides of said object, and affixing said attachment means to a pair of spaced-apart locations on said inside surface of said drum and on opposite sides of said object, whereby said object can be easily, securely, and removably attached to said inside surface of said drum for drying said object within said drum without tumbling said object within said drum.

15. The method of claim 14 wherein said securing of said object directly against said inside surface of said drum is performed by first affixing one of said attachment means to a first location on said inside surface of said drum, them placing said object directly against said inside surface of said drum, then extending said holding member over said object, and then a fixing said other of said attachment means to another location on said inside surface of said drum and on an opposite side of said object.

16. The method of claim 14 wherein said straps are made of a strong, heat-resistant fabric, and said attachment means is selected from the group consisting of suction cups, permanent magnets, adhesive pads, and hooks.

17. The method of claim 14 wherein said inside surface of said drum has a plurality of inwardly projecting radial vanes and wherein said object is placed against one of said vanes.

18. An apparatus for facilitating the drying of a solid object, within a dryer of the type having a rotating drum which has an inside surface defining a working chamber within said drum, said apparatus comprising:

an elongated, flexible holding member having a pair of opposite ends, said holding member comprising a pair of straps and containing adjustment means for enabling the length of said straps between said opposite ends to be adjusted so that said member can extend over any object within a predetermined size range, and a pair of attachment means affixed to said opposite ends of said holding member, respectively, each of said attachment means being arranged to attach its respective end of said holding member to a location on said inside surface of said drum in a manner such that said respective end of said holding member can be repeatedly attached and removed form said location on said inside surface of said drum, whereby said holding member and said attachment means can be used to attach said object easily, securely, and removably to said inside surface of said drum, so as to engageable said object to be dried within said drum, without tumbling said object within said drum, by extending said holding member over said object an using said attachment means to attach said opposite ends of said holding member to a pair of spaced-apart locations on said inside surface of said drum and on opposite sides of said object.

19. The apparatus of claim 18 wherein each of said straps has inner and outer ends, said inner ends of said straps having connecting means for removably connecting said inner end together, said outer ends of said straps consisting said opposite ends of said flexible holding member.

20. The apparatus of claim 19 wherein said connecting means for removably connecting said inner ends together comprises one part of a hook-and-loop fastener on at lest one side of one of said straps and the other part of said hook-and-loop fastener on the other of said straps, said straps being made of a heat-resistant fiber.

21. The apparatus of claim 20 wherein each of said attachment means comprises suction cup having a vacuum suction portion and a cylindrical holding portion.

22. An apparatus for facilitating the drying of a solid object, within a dryer of the type having a rotating drum which has an inside surface defining a working chamber within said drum, said apparatus comprising:

an elongated, flexible holding member having a pair of opposite ends, said holding member containing adjustment means for enabling its length between said opposite ends to be adjusted so that said member can extend over nay object within a predestined size range, and a pair of attachment means affixed to said opposite ends of said holding member, respectively, each of said attachment means comprising a suction cup and being arranged to a attach its respectable end of said holding member to a location on said inside surface of said drum in a manner such that said respective ends of said holding member can be repeatedly attached and removed form said location on said inside surface of said drum, whereby said holding member and said attachment means can be used to attach said object easily, securely, and removably to said inside surface of is drum, so as to enable said object to be dried within said drum, within tumbling said object within said drum, by extending said holding member over said object and using said attachment means to attach said opposite ends of said holding member to a par of spaced-apart location son said inside surface of said drum and on opposite sides of said object.

23. The apparatus of claim 22 wherein said holding member comprises at least one pair of straps, each of which has inner and outer ends, said inner ends of said straps having connecting means for removably connecting said inner ends together, said outer ends of said straps consisting said opposite ends of said flexible holding member.

* * * * *